US009341397B2

(12) United States Patent
Martinez Aroca

(10) Patent No.: US 9,341,397 B2
(45) Date of Patent: May 17, 2016

(54) ELECTRICAL APPLIANCE THAT CAN ALSO BE USED IN INDUSTRY FOR COOLING OR FREEZING PRODUCTS WITH MAXIMUM SPEED

(71) Applicant: Jose Antonio Martinez Aroca, Gandia (ES)

(72) Inventor: Jose Antonio Martinez Aroca, Gandia (ES)

( * ) Notice: Subject to any disclaimer, the term of this patent is extended or adjusted under 35 U.S.C. 154(b) by 186 days.

(21) Appl. No.: 13/944,578

(22) Filed: Jul. 17, 2013

(65) Prior Publication Data

US 2014/0041408 A1 Feb. 13, 2014

Related U.S. Application Data

(63) Continuation-in-part of application No. PCT/ES2012/000011, filed on Jan. 13, 2012.

(51) Int. Cl.

| | |
|---|---|
| ***F25D 23/06*** | (2006.01) |
| ***F25B 39/02*** | (2006.01) |
| ***F25D 31/00*** | (2006.01) |
| ***F25B 43/00*** | (2006.01) |
| *F25D 29/00* | (2006.01) |
| *F25B 31/00* | (2006.01) |

(52) U.S. Cl.

CPC ..... *F25B 39/02* (2013.01); *F25B 43/003* (2013.01); *F25D 31/007* (2013.01); *F25B 31/002* (2013.01); *F25D 29/00* (2013.01); *F25D 2400/28* (2013.01)

(58) Field of Classification Search

CPC ... F25D 31/006; F25D 31/007; F25D 31/008; F25D 23/061; F25D 23/062; F25D 23/063; F25D 23/064; F25D 23/068

See application file for complete search history.

(56) References Cited

U.S. PATENT DOCUMENTS

| | | | | |
|---|---|---|---|---|
| 2,297,908 | A | 6/1942 | Money | |
| 3,845,637 | A | 11/1974 | Shepherd | |
| 4,457,140 | A | 7/1984 | Rastelli | |
| 4,624,112 | A * | 11/1986 | Proctor | 62/149 |
| 5,367,887 | A | 11/1994 | Byrd et al. | |
| 5,927,087 | A * | 7/1999 | Ishikawa | 62/174 |
| 6,385,991 | B1 | 5/2002 | Romanosky | |
| 2005/0022549 | A1 * | 2/2005 | Anderson et al. | 62/317 |
| 2011/0023532 | A1 * | 2/2011 | Kobayashi et al. | 62/498 |

FOREIGN PATENT DOCUMENTS

| | | | |
|---|---|---|---|
| GB | 594737 | A | 11/1947 |
| WO | WO 2007096698 | A1 | 8/2007 |
| WO | WO 2009141127 | A2 | 11/2009 |

* cited by examiner

*Primary Examiner* — Frantz Jules
*Assistant Examiner* — Erik Mendoza-Wilkenfe
(74) *Attorney, Agent, or Firm* — Porzio, Bromberg & Newman, P.C.

(57) ABSTRACT

Electrical appliance that can be used in industry for cooling or freezing products with maximum speed by selecting the desired temperature or time from a control panel. The gas R410A, when introduced into the compressing motor is responsible for compressing the gas of the circuit passing through the coil. The condenser, the first filter dryer, the capillary tube, the evaporator, the second filter dryer being strategically placed for rearranging the particles and molecules, continuing through the coil until returning to the compressing motor. This set of components becoming a single closed circuit, without the need to be recharged. One or more fans are placed on walls or ceiling of the evaporator for transmitting a cold shock or thermal sensation making use of the cold existing within the evaporator. A second filter can be strategically placed for cooling with maximum speed.

5 Claims, 5 Drawing Sheets

ELECTRICAL APPLIANCE THAT CAN ALSO BE USED IN INDUSTRY FOR COOLING OR FREEZING PRODUCTS WITH MAXIMUM SPEED

OBJECT OF THE INVENTION

The patent object of the description, in this case relates to novel design and creation of a determined apparatus or electrical appliance with which products can be cooled in an accelerated manner such as e.g. beverages, and all kinds of food, both domestically in households, and industrially in bars, restaurants, ice cream parlors, or in venues where events are held, and in other possible industrial environments, where it can serve for cooling or freezing products, regardless of whether or not they are food, and even in fishing ports, vessels and fish markets, or markets for the agri-food industry, due particularly to the new electrical appliance that operates with a system of ducts full of a specific gas, the rubbing and moving friction of which generate, helped by fans, cooling at the fastest execution, which may be programmable or calculated based on weights and capacities. Therefore, through the application of this invention, conceived with the purpose of providing numerous advantages of use applied directly to cooling or freezing, the problems relating to the need, urgency, or capricious action of cooling, and if required, freezing beverages or food, and other products very quickly are completely solved.

FIELD OF THE INVENTION

The scope of application of the invention is the one encompassing the entire industry dedicated to the production and marketing or processing, storage and supply of all kinds of perishable products in general, as well as sectors intended for the restaurant and catering trade, or cafeterias or restaurants or ice cream parlors, in general, together with clubs and leisure environments, and on the other hand, also including in this same area sectors framed in the manufacture of small and large electrical appliances, and manufacturing sectors dealing with the production of duct systems and open or closed circuit coil systems, which serve to incorporate both fluids and substances generally as liquids or gases.

BACKGROUND OF THE INVENTION

At present, the existence of an invention having the features described in the specification of the Patent itself is unknown to the applicant, therefore its use is entirely novel.

Currently, in all types of kitchens, there is a series of electrical appliances which contribute in a multitude of tasks providing cooking, refrigeration, heating and freezing or thawing of foods and beverages, so that for some cases, such as cooking and heating or thawing, the speed and speed of execution have been optimized, but the same has not happened, relatively, when you need to cool or freeze very quickly or in the shortest possible time any food product, with the important advantage that would represent to always have water, soft drinks, beverages in general, or, ultimately, food, rapidly cooled or frozen in a few minutes.

In addition, all domestic needs have been industrially adapted to shops, markets, and a wide variety of companies engaged in cooking that need to maintain foods hot or cold, and that even need to keep all foods frozen.

As for ways or means of accelerating or keeping the cold in a closed environment to produce a greater decrease in temperature, the existence of rudimentary products is known based on the addition and mixture of salt and ice in combination with a rotating container in which the product to be cooled is introduced rotating it to achieve with patience its cooling and keeping it cold.

To date, there is no knowledge of any electrical appliance or apparatus applied in industries and public facilities, that is capable of cooling and, if required, freezing, with maximum speed beverages in general together with foods previously cooked or also mainly perishable products, or which need to be kept at a certain temperature and freshness, so that it is essentially practical, useful, and highly functional as electrical appliance in households, as well as for its use industrially applied with dimensional variations of the electrical appliance which effectively serve in numerous sectors in which it can be presented as an invention that offers multiple features of practicality and usability with regard to any need to cool very quickly, in addition to functioning as an electrical appliance that freezes in a few minutes, depending on the product and its volume, weight, and the condition of the same.

DESCRIPTION OF THE INVENTION

This electrical appliance which can also be applied to the industry for cooling or freezing with maximum speed, to which the description refers as such in this case corresponds to the creation of a specific domestic and industrial electrical appliance, which is configured from insulation structures or paneling that give rise, after being integrated forming part of metal plate or plastic material supports surrounding tightly in an enveloping manner the insulating paneling, to a set of delimiting walls of both cubic and prismatic container receptacles and more or less elongated or, if necessary, enlarged when convenient.

The insulation paneling must meet insulating qualities which protect and prepare the interior space of the electrical appliance, with combinations of materials or with layers that are located more toward the outer side of the paneling in order to protect the electrical appliance itself from adverse external conditions, with fireproof and moisture insulating material to prevent dangerous accidents.

And the walls mentioned above provide the entire peripheral boundary of the electrical appliance, for use also applicable in the industry, which can be joined together by brackets, fittings, grid structures, and even split from a single object based on molds or drawing processes, generating the hollow walls inside, for placing the insulation paneling at the later stage of manufacture of the entire electrical appliance, which allows insulating the evaporator from the rest of the components achieving a uniform and accelerated cooling in a programmable manner in time or by the weight of the product. Also the desired temperature at which you want to cool or freeze beverages and foods in general can be selectable.

Within these insulation paneling there is a space called evaporator, which houses the foods or beverages, the composition of which is a copper coil, this copper coil forming part of a closed circuit through which the cooling gas passes.

On the other hand, within the evaporator there are installed fans in order to generate several air currents, said fans being strategically located such that the air existing within the evaporator flows quickly over the beverages or foods inside the evaporator itself, this component being completely sealed and therefore it does not need air from the outside nor to expel air.

The purpose and strategic location of these fans within the evaporator, the evaporator being continuously at −40° C., is to create a thermal sensation over the beverages or foods that reaches between −60° C. and −70° C.

The evaporator is shown delimited by perforated plate panels, in order to prevent accidents with the fan blades by direct contact with foods or beverages, but in turn, allowing the air to flow smoothly within the enclosed area itself, called evaporator, always respecting a usually front opening, although it can also have a side or top opening, and in all cases with hinged door, or removable by sliding, which covers the entire opening, the function of which is to allow a comfortable introduction of products in the electrical appliance.

As for the gas, which is preferably used and therefore can be applied to the invention, the so-called R410A fits perfectly as essential refrigerant compound in the novel electrical appliance, because it provides a very high volumetric capacity that simply because of its natural characteristics reaches high pressure, derived from less displacement of the molecules making up the gas R410A and in increased cooling capacity.

The gas R410A is a hydro fluorocarbon (HFC) and it is a cooling gas classified as completely ecological that does not damage the ozone layer, and it is not detrimental to the health of people, in addition to being a non-flammable gas, so that in case of leaks, accidents or intoxication causing side effects when inhaled would not occur.

Hence, the invention does not consider exclusive the use of this gas R410A, although initially it is the most appropriate, but in the case of this product being removed or disappearing from the market, other gases with similar qualities having identical cooling functions may be used, based always on the characteristics and performance of R410A.

Due to the high natural working pressure and cooling of the R410A itself, it has a boiling point of −52° C., and therefore is suitable for this new electrical appliance.

The new electrical appliance comprises a copper coil which serves as connection or link between the various components starting from the compressing motor, connecting the compressing motor, the condenser, the first filter dryer, the capillary copper tube, the evaporator, the second filter dryer placed strategically, the last stretch of copper coil being the one that rejoins to the compressing motor, this allowing the set of the various components to be a single closed circuit.

The new electrical appliance comprises a compressing motor, which is intended to arrange the gas R410A particles and molecules, and also to continuously push the gas, in gaseous state, within the closed circuit formed by a condenser, filter dryers, an evaporator, each of the components connected by a copper coil of several sections in its corresponding path.

The compressing motor has a fan attached on its rear part in order to remove the heat it produces.

The new electrical appliance comprises a condenser, which may have either rectangular or prismatic shape known, and the condenser receives the gas from the compressor through a portion of the coil, and since the gas is in gaseous state at 50° C., the condenser has two important functions, namely, first, to accumulate approximately 800 g of gas which is the load that is suitable for the proper operation of the electrical appliance, and the second function is to cool the gas R410A as it passes, since for this task an independent fan has been placed for cooling the condenser and the gas flowing inside the condenser.

The new electrical appliance comprises two filter dryers, strategically located, namely the first filter dryer is located between the condenser and the evaporator, and its purpose is to clutter the particles and molecules of the gas R410A, passing the gas through a capillary tube, and thus converting the gas from gaseous state to liquid state and causing the temperature of the gas to go down to −52° C., the gas continuing its travel to the evaporator, where the food or beverages are placed.

The new electrical appliance comprises the second filter dryer without capillary tube, strategically located after the evaporator and immediately before the compressing motor, and it is intended, since it is strategically placed, to rearrange the gas particles and molecules, thus allowing the gas to reenter inside the compressing motor in an orderly manner, therefore, the compressing motor does not have to rearrange the gas particles and molecules, such that the gas continues its travel within the closed circuit, achieving nullifying the time used by the compressing motor rearranging the particles and molecules of the gas that takes between 8 and 10 minutes, and therefore, accelerating the so-called cold cycle, thereby allowing in an innovating manner the gas to flow within the closed circuit without obstacle, achieving the electrical appliance to go from 25° C. as room temperature to −40° C. in just 6 minutes, cooling cans of soda from 25° C. to 7° C., in just 5 minutes, which compared with the current traditional system for cooling cans of soda from 25° C. to 7° C., uses 1 hour and 15 minutes, this thus accelerates the cooling or freezing up to 15 times faster than any current method known.

BRIEF DESCRIPTION OF THE DRAWINGS

To complement this description being carried out and with the object of contributing to a more detailed understanding of the features offered by the novelty a series of line drawings is attached to this specification and as an integral part thereof, representing the following illustrative purposes.

PREFERRED EMBODIMENT OF THE INVENTION

Figure 1:
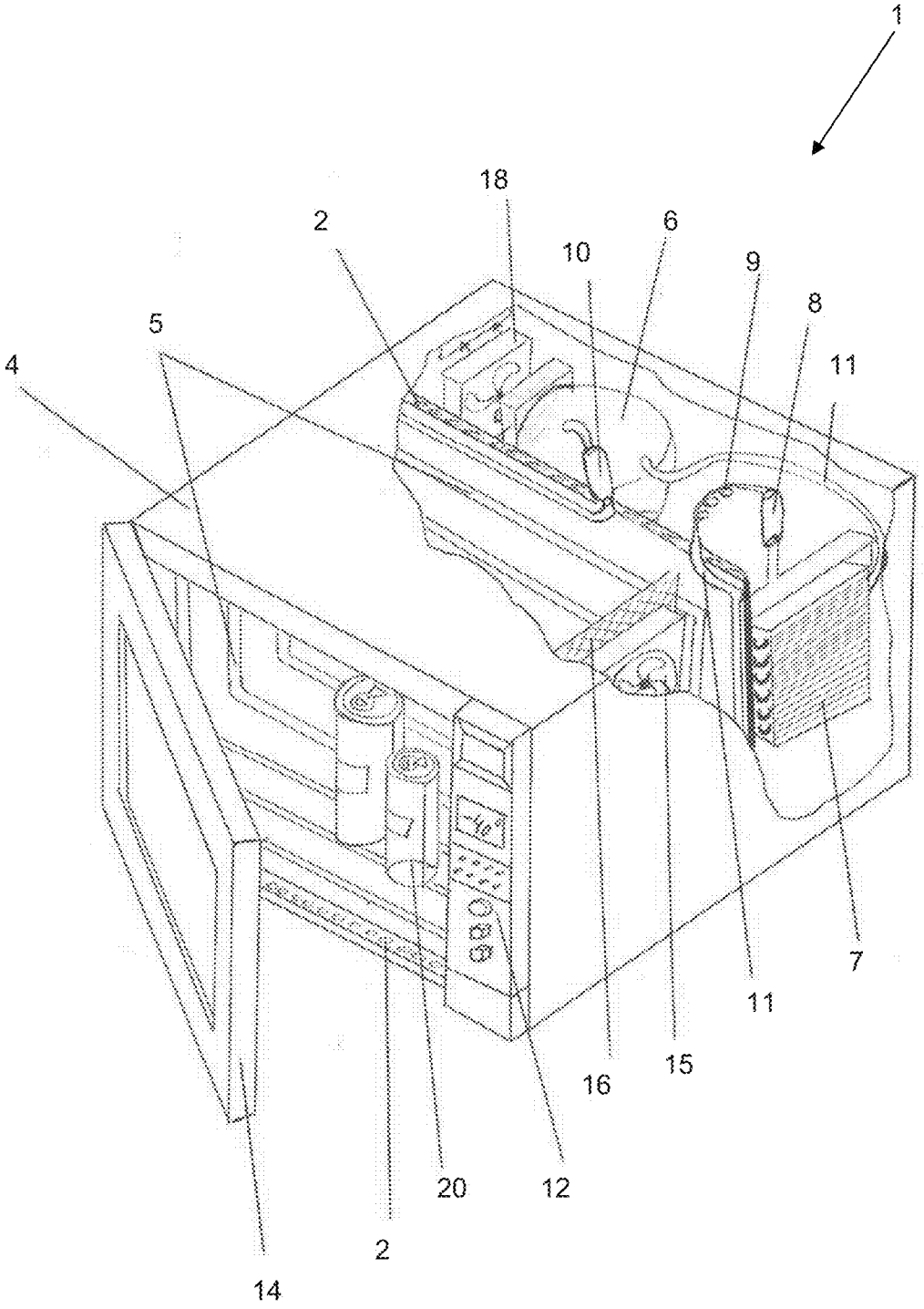
FIG. 1—It is the depiction of an electrical appliance for cooling or freezing beverages and any food product with maximum speed, all this from a perspective where a metallic structure is shown and through the cut made the compressing motor, the evaporator, the condenser, part of the internal fans, as well as the interior space since the apparatus is depicted with the door open, showing, as examples, canned beverage containers.
Figure 2:
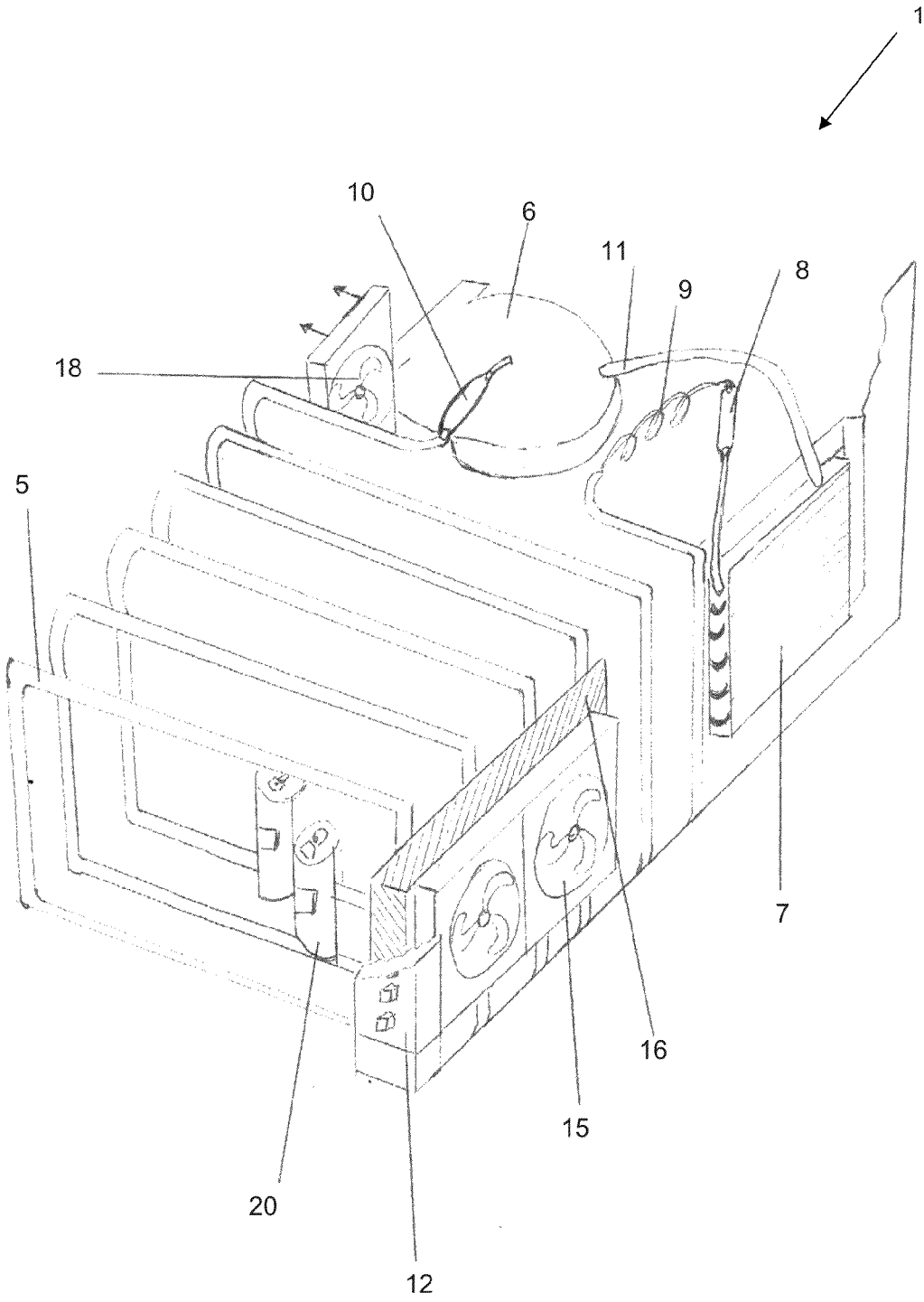
FIG. 2—It depicts, from a perspective view, the whole cooling structural system called evaporator, showing the compressing motor, the internal fans without depicting walls or door forming part of the electrical appliance, appearing only a portion of the console or control panel.
Figure 3:
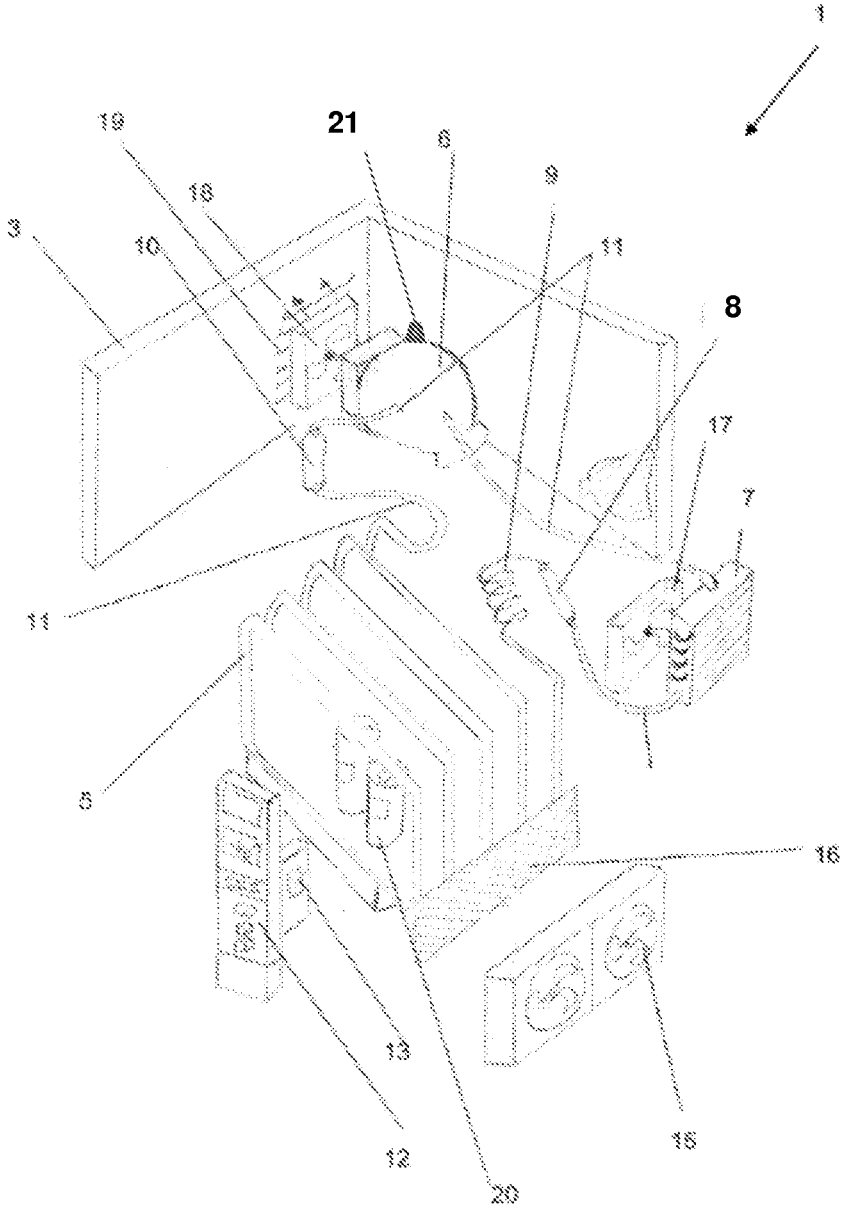
FIG. 3—It shows, from another perspective view, all the elements forming the invention, moving the majority of the components from their final positions to be observed separately, and making various cuts in several objects such that elements that are hidden can be appreciated.
Figure 4:
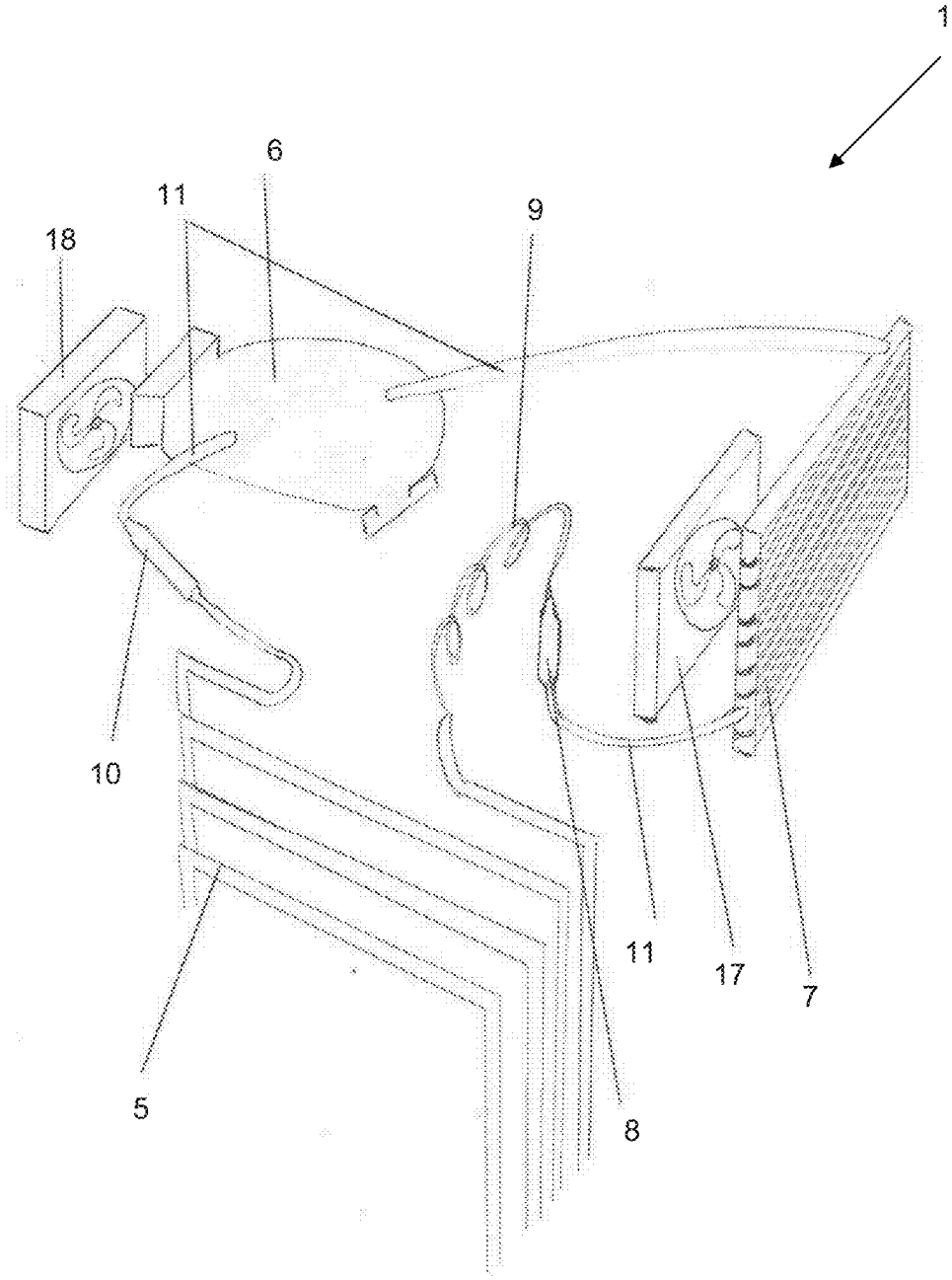
FIG. 4—It shows the components without depicting walls or door forming part of the electrical appliance showing the compressing motor, and this in turn, from the outlet port shows the coil carrying the gas R410A to the condenser shown along with its fan for cooling it, the duct following the first filter dryer in order to clutter the particles and molecules of the gas R410A, subsequently passing the gas through a capillary tube, and thus converting the gas from gaseous state to liquid state and causing the temperature of the gas to go down to −52° C., the gas continuing its travel through the evaporator seen in section showing the outlet of the duct at the other end of the coil for conducting the gas R410A through the second filter dryer, strategically positioned after the evaporator and immediately before the compressing motor without capillary tube, the purpose of this second filter being, since it is strategically positioned, to rearrange the gas particles and molecules, thus allowing it to re-enter into the compressing motor in an orderly manner, and in this way, the compressing motor does not have to re-arrange them and it continues its travel inside the closed circuit, drastically reducing the cooling or freezing time of beverages or foods.
Figure 5:
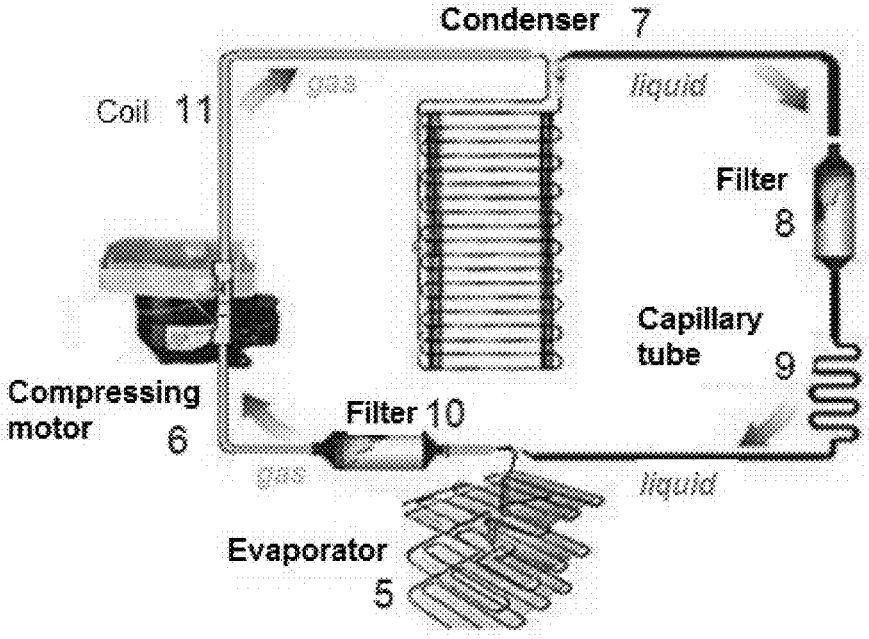
FIG. 5—It represents a cooling cycle scheme of electrical appliance with second filter dryer strategically placed, as shown in the scheme, and the strategic location of the second filter dryer is what we highlight as novelty.

In view of FIG. 1, this novel electrical appliance also applicable in the industry for cooling or freezing products with maximum speed (1), is configured from insulation paneling (2) which are framed within metal plate supports (3) to produce the walls (4) of the sides and bottom together with the top and bottom of the electrical appliance characteristic of the present invention.

The walls may be assembled with each other so that it results in a kind of receptacle or interior space, the front of the electrical appliance (1) being open with a door (14), hinged or removable by sliding, for access and closing of said interior space.

On the inner faces of the evaporator (5) there are installed fans (15) generating air inside the evaporator space itself causing a thermal sensation of about −60° C., these fans (15) being separated from the evaporator (5) by a perforated plate (16) to prevent accidents with the cans (20) in this case.

There is an inline valve (21) housed in the inlet port of the compressing motor (6) so that the load of the gas R410A can be performed, and when it is introduced into the compressing motor (6), this is responsible for completely filling the circuit passing through the coil (11), the condenser (7), the first filter dryer (8), the capillary tube (9), the evaporator (5), the second filter dryer (10) strategically placed, continuing through the coil (11) until returning to the compressing motor (6), this set of components becoming a single closed circuit, without the need to be recharged.

A fan (18) is attached to the compressing motor (6) for extracting the heat generated through a vent grille (19), also the condenser (7) has a fan (17) attached to it for extracting the heat generated through a vent grille (19).

Like any apparatus with programmable functions and also of immediate action, the new electrical appliance (1) includes a console or control panel (12), connected to a circuit board (13) for processing times, speeds, temperatures, weights, volumes and automatic programming, which operates connected to the power supply directly at 220V.

So it can be concluded that, overall, a more complete electrical appliance (1) is obtained, created under the important purpose of cooling or freezing products with the maximum cooling and freezing speed, depending on the action to be exerted on the product, with very fast features and use and implementation advantages.

The elements and materials used in the manufacture of the electrical appliance that can also be used in industry for cooling or freezing products with maximum speed (1), are those described in the present invention and any of the dimensions and shapes of the elements forming it may be varied or modified, by virtue of the possible variations that occur in the market.

The terms in which the present Patent specification is described will always be taken with a broad and non-limiting character.

The invention claimed is:

1. An electrical appliance for cooling or freezing products with maximum speed, comprising enclosing walls, comprising a metal plate support adapted to covers moisture-proof, fire-retardant or other insulators insulation paneling, which in turn cover an evaporator, so that the walls generate a watertight and airtight receptacle or interior space, the walls being assembled with each other, the walls adapted to accommodate beverages and foods one or more fans placed on the inner face of all or part of the walls which generate air within the sealed walls without allowing entry or exit of air from within the sealed walls, so the air generated by the one or more fans being in fluid communication with the evaporator itself, this being at −40° C., the one or more fans causing a thermal sensation on foods or beverages of about −60° C., and a compressing motor, adapted for completely filling a circulating circuit of a cooling gas passing through a coil, a condenser, a first filter dryer, a capillary tube, the evaporator, and a second filter dryer, the second filter dryer being placed, immediately after the evaporator without a capillary tube, continuing through the coil until returning to the compressing motor, the circuit becoming a single closed circuit which does not need to be recharged with refrigerant.

2. The electrical appliance for cooling or freezing products with maximum speed, according to claim 1, wherein the cooling gas is R410A gas, the electrical appliance being suitable for high pressures of the R410A gas, an inline valve being used to introduce the gas R410A into the compressing motor and this introduces the R410A gas into the circulating circuit.

3. The electrical appliance for cooling or freezing products with maximum speed, according to claim 1 further comprising a console or control panel, associated with a circuit board, from which are selected processing times, temperatures and other programs or programmable actions and a relief area at the compressing motor area through which the air may exit without prejudice of the features provided in the interior space of the electrical appliance.

4. The electrical appliance for cooling or freezing products with maximum speed, according to claim 1, wherein the cooling gas is R410A gas wherein the second filter dryer, is having as a purpose to rearrange the particles and molecules of the R410A gas, which when entering into the compressing motor with the particles and molecules arranged causes that the compressing motor does not have to rearrange the particles and molecules, which is known as the cold cycle that lasts approximately 10 minutes, and therefore the second filter redirects the gas directly to the circuit, dramatically accelerating the process of cooling or freezing, achieving the electrical appliance to go from 25° C. to −40° C. in just 6 minutes and cooling cans of soda or food from 25° C. to 7° C., in about 5 minutes.

5. The electrical appliance for cooling or freezing products with maximum speed according to claim 1, wherein the interior space has an opening in which to install a door, hinged or removable by sliding.

* * * * *